US008111224B2

(12) United States Patent
Park et al.

(10) Patent No.: US 8,111,224 B2
(45) Date of Patent: Feb. 7, 2012

(54) ORGANIC LIGHT EMITTING DIODE DISPLAY AND DISPLAY PANEL AND DRIVING METHOD THEREOF

(75) Inventors: Sung-Chon Park, Suwon-si (KR); Won-Kyu Kwak, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 1042 days.

(21) Appl. No.: 11/204,947

(22) Filed: Aug. 15, 2005

(65) Prior Publication Data

US 2006/0044245 A1 Mar. 2, 2006

(30) Foreign Application Priority Data

Aug. 26, 2004 (KR) ..... 10-2004-0067452

(51) Int. Cl.
*G09G 3/32* (2006.01)

(52) U.S. Cl. ..... 345/83

(58) Field of Classification Search ..... 345/76, 345/77, 83, 204, 690; 315/169.3; 348/800–801
See application file for complete search history.

(56) References Cited

U.S. PATENT DOCUMENTS

| | | | | |
|---|---|---|---|---|
| 6,134,200 | A | 10/2000 | Timmermans | |
| 6,268,841 | B1 * | 7/2001 | Cairns et al. | 345/100 |
| 6,326,981 | B1 * | 12/2001 | Mori et al. | 345/695 |
| 6,421,033 | B1 * | 7/2002 | Williams et al. | 345/55 |
| 7,221,337 | B1 * | 5/2007 | Choi et al. | 345/77 |
| 2002/0070909 | A1 * | 6/2002 | Asano et al. | 345/76 |
| 2003/0214469 | A1 | 11/2003 | Kageyama et al. | |
| 2004/0239658 | A1 * | 12/2004 | Koyama et al. | 345/204 |

FOREIGN PATENT DOCUMENTS

| | | |
|---|---|---|
| CN | 1333527 A | 1/2002 |
| DE | 4107021 | 9/1991 |
| DE | 19633417 | 12/1997 |
| DE | 69603769 | 3/2000 |
| EP | 0 738 078 | 8/1999 |
| EP | 1 174 855 A2 | 1/2002 |

(Continued)

OTHER PUBLICATIONS

Yumoto, Akira. "Active matrix type display device and active matrix type organic electrolumiescence display device." Apr. 25, 2003. English Machine Translation of JP Publication 2003-122306 (Application 2001-312322).*

(Continued)

*Primary Examiner* — Chanh Nguyen
*Assistant Examiner* — Allison Walthall
(74) *Attorney, Agent, or Firm* — Christie, Parker & Hale, LLP

(57) ABSTRACT

An organic light emitting diode display, and a display panel and driving method thereof are provided. The organic light emitting diode display includes a plurality of data lines for transmitting data signals, a plurality of scan lines for transmitting selection signals, and a plurality of pixel circuits coupled to the data lines and the scan lines. The pixel circuits include at least four emitting elements for emitting light corresponding to amount of an applied current, a light emitting element driver for outputting a data current corresponding to at least one of the data signals, and a switching unit for respectively transmitting the data current to the four emitting elements. In the display, at least two emitting elements of the four light emitting elements are formed in different places.

21 Claims, 9 Drawing Sheets

FOREIGN PATENT DOCUMENTS

| | | |
|---|---|---|
| HU | 216669 | 9/1992 |
| JP | 4-316091 | 11/1992 |
| JP | 6-324660 | 11/1994 |
| JP | 09-138659 | 5/1997 |
| JP | 2000306315 | 11/2000 |
| JP | 2002-032051 | 1/2002 |
| JP | 2002-244619 | 8/2002 |
| JP | 2003-510661 | 3/2003 |
| JP | 2003-122306 | 4/2003 |
| JP | 2004-133240 | 4/2004 |
| JP | 2004-226960 | 8/2004 |
| WO | WO 01/24153 A1 | 4/2001 |
| WO | 02054781 | 7/2002 |
| WO | WO 2004/051614 A1 | 6/2004 |

OTHER PUBLICATIONS

Mobilfunknetze, TV im Auto—aber bitte nicht fur den Fahrer, Jun. 1995, No. 6, Mar. 3, 1995.

I. Hutter et al., Entwicklung eines DVD-Players: Probleme and Losungen, Femseh Und Kino—Technik 53, Jahrgang Nr. Nov. 1999, p. 664-669.

* cited by examiner

ORGANIC LIGHT EMITTING DIODE DISPLAY AND DISPLAY PANEL AND DRIVING METHOD THEREOF

CROSS REFERENCE TO RELATED APPLICATION

This application claims priority to and the benefit of Korean Patent Application No. 10-2004-0067452, filed on Aug. 26, 2004 in the Korean Intellectual Property Office, the entire content of which is incorporated herein by reference.

BACKGROUND OF THE INVENTION

1. Field of the Invention

The present invention relates to an organic light emitting diode display, and a display panel and driving method thereof.

2. Discussion of the Related Art

Generally, organic light emitting diode (OLED) displays are display devices that emit light by electrically exciting an organic compound. An organic light emitting diode display includes N×M organic light emitting cells (or pixels) arranged in the form of a matrix, and displays an image by driving the organic light emitting cells, using voltage or current.

An organic light emitting cell has a structure including an anode electrode layer (e.g., indium tin oxide: ITO), an organic thin film, and a cathode electrode layer. To achieve an improved balance between electrons and holes, and thus an enhancement in light emitting efficiency, the organic thin film has a multi-layer structure including an emitting layer (EML), an electron transport layer (ETL), and a hole transport layer (HTL). The organic thin film also includes an electron injecting layer (EIL) and a hole injecting layer (HIL).

Methods for driving an organic light emitting diode display include a passive matrix method and an active matrix method which uses thin film transistors (TFT) to drive organic light emitting cells of the organic light emitting diode display. In the passive matrix method, an anode and a cathode are formed crossing each other, and a line is selected in order to drive an organic light emitting cell. However, in the active matrix method, a thin film transistor is coupled to an indium tin oxide (ITO) pixel electrode of an organic light emitting cell, and the organic light emitting cell operates according to a voltage maintained by the capacitance of a capacitor coupled to a gate of the thin film transistor. The active matrix method can be further divided into a voltage programming method and a current programming method according to a signal, which is applied to program a voltage of the capacitor.

In a conventional organic light emitting diode display, a pixel includes a plurality of sub-pixels having respective colors in order to express various colors, and a color is expressed by a combination of the respective colors emitted from the sub-pixels. Generally, one pixel includes a sub-pixel for red (R), a sub-pixel for green (G), and a sub-pixel for blue (B), and a color is expressed by a combination of the red, green, and blue.

However, in order to drive the sub-pixels, the respective sub-pixels must include a driving circuit for driving an organic light emitting element (e.g., an OLED), a data line for transmitting a data signal, a scan line for transmitting a scan signal, and a power line for transmitting a power voltage. Accordingly, the organic light emitting diode display must include a large number of lines (e.g., scan and data lines) and circuits for driving the pixels. The lines are difficult to arrange in the limited display area of the conventional organic light emitting display, and an aperture ratio corresponding to an emitting pixel area of the conventional organic light emitting display can be reduced.

SUMMARY OF THE INVENTION

An embodiment of the present invention provides a light emitting diode display for increasing an aperture ratio.

An embodiment of the present invention provides a light emitting diode display for simplifying an arrangement of lines (e.g., scan and data lines) and a configuration of elements included in a pixel.

An embodiment of the present invention provides a light emitting diode display for reducing a number of data lines and scan lines.

Additional features of the invention will be set forth in the description which follows.

One embodiment of the present invention provides an organic light emitting diode display including a plurality of data lines for transmitting data signals, a plurality of scan lines for transmitting selection signals, and a plurality of pixels coupled to the data lines and the scan lines. At least one of the pixels includes at least four light emitting elements for emitting a light corresponding to amount of an applied current, a light emitting element driver for receiving at least one of the data signals while a corresponding one of the selection signals is applied and for outputting a data current corresponding to the at least one of the data signals, and a switching unit for respectively transmitting the data current from the light emitting element driver to the four light emitting elements. In this embodiment, at least two light emitting elements of the four light emitting elements are formed in different places with reference to the scan lines and the data lines.

One embodiment of the present invention provides a display panel for an organic light emitting diode display. The display panel includes: a display area having a plurality of data lines for transmitting data signals, a plurality of selection signals for transmitting selection signals, and a plurality of pixels coupled to the data line and the scan line; a data signal driver for time-dividing at least four of the data signals and for applying the time-divided data signals to at least one of the data lines in one field; and a scan driver for sequentially applying the selection signals to the plurality of scan lines. In this embodiment, at least one of the pixel includes: at least four light emitting elements for emitting light corresponding to amount of an applied current; a light emitting element driver for receiving the time-divided data signals while the selection signals is applied, and for outputting a data current corresponding to at least one of the time-divided data signals; and a switching unit for respectively transmitting the data current to the four light emitting elements. First and second light emitting elements of the four light emitting elements are formed parallel to at least one of the scan lines, and third and fourth light emitting elements of the four light emitting elements are formed vertically with respect to the first and second light emitting elements.

One embodiment of the present invention provides a method for driving a display panel including a plurality of data lines for transmitting data signals, a plurality of selection signals for transmitting selection signals, and a plurality of pixels coupled to the data lines and the scan lines. In this embodiment, at least one of the plurality of pixels includes at least four light emitting elements, and a field is divided into at least four subfields. In the method, the selection signals are sequentially applied to the plurality of scan lines in the respective subfields, at least one of the data signals is programmed to at least one of the plurality of data lines while a corresponding one of the selection signals is applied, and a current corresponding to at least one the data signals is sequentially transmitted to the four light emitting elements. First and second light emitting elements of the four light emitting elements are formed parallel to at least one of the scan lines, and third and fourth light emitting elements of the four light emitting elements are formed vertically with respect to the first and second light emitting elements.

BRIEF DESCRIPTION OF THE DRAWINGS

The accompanying drawings, together with the specification, illustrate exemplary embodiments of the present invention, and, together with the description, serve to explain the principles of the invention.

DETAILED DESCRIPTION

Figure 1:
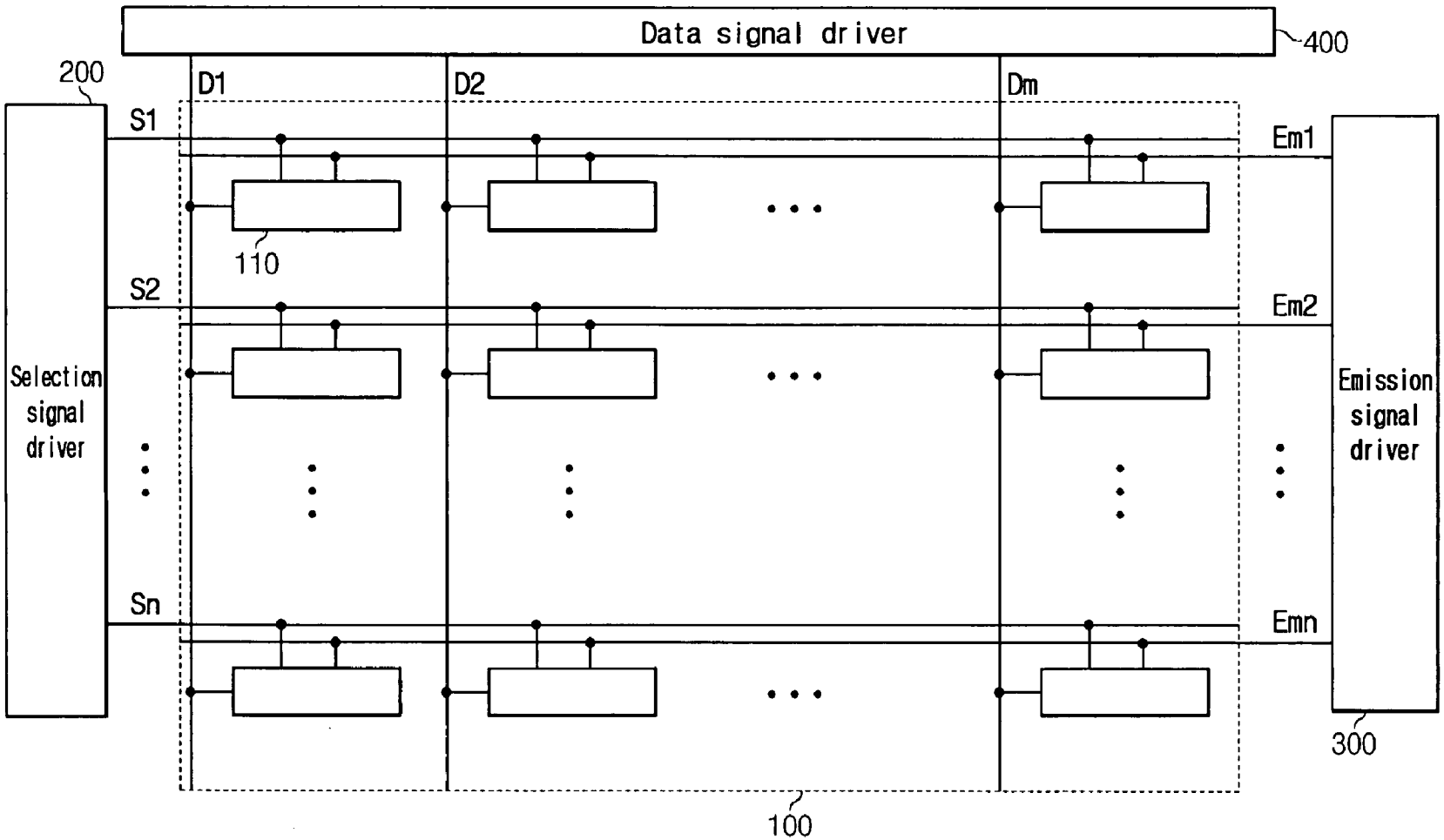
FIG. 1 shows a schematic diagram for representing an organic light emitting diode display according to a first exemplary embodiment of the present invention.

In the following detailed description, only certain exemplary embodiments of the present invention are shown and described, simply by way of illustration. As those skilled in the art would realize, the described embodiments may be modified in various different ways, all without departing from the spirit or scope of the present invention. Accordingly, the drawings and description are to be regarded as illustrative in nature, and not restrictive. There may be parts shown in the drawings, or parts not shown in the drawings, that are not discussed in the specification as they are not essential to a complete understanding of the invention. Like reference numerals designate like elements.

Exemplary embodiments of the present invention will now be described in detail with reference to the annexed drawings.

Figure 2:
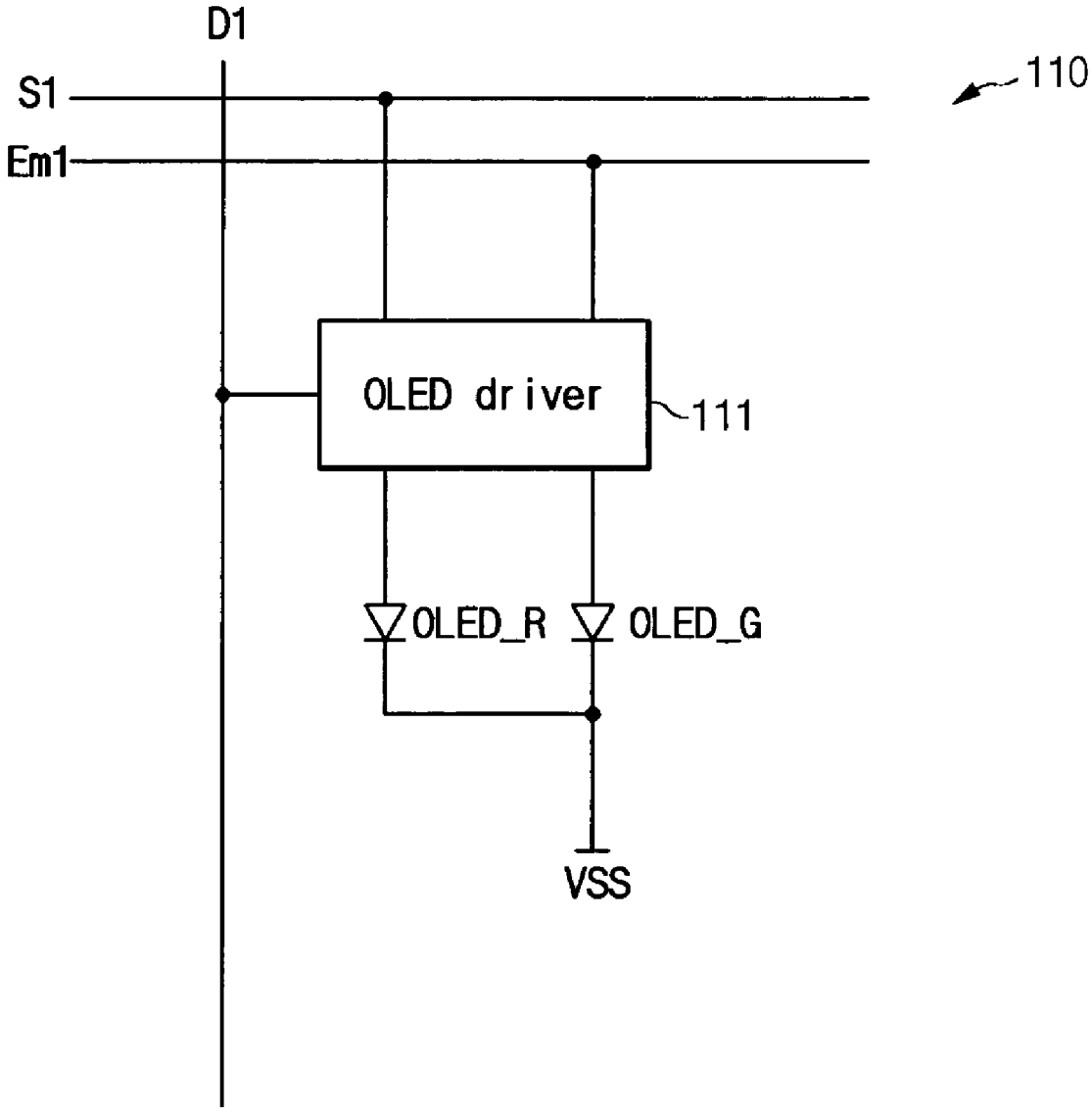
FIG. 2 shows a schematic diagram for representing a pixel of the organic light emitting diode display of FIG. 1.

FIG. 1 shows a schematic diagram for representing an organic light emitting diode display according to a first exemplary embodiment of the present invention, and FIG. 2 shows a schematic diagram for representing a pixel of the organic light emitting diode display of FIG. 1.

As shown in FIG. 1, the organic light emitting diode display according to the first exemplary embodiment of the present invention includes a display panel 100, a selection signal driver 200, an emission signal driver 300, and a data signal driver 400. The display panel 100 includes a plurality of selection and emission scan lines S1 to Sn and Em1 to Emn arranged in a row direction, a plurality of data lines D1 to Dm arranged in a column direction, and a plurality of pixels 110. A pixel is formed in a pixel area defined by two neighboring scan lines and two neighboring data lines. As shown in FIG. 2, each pixel 110 includes an organic light emitting diode (OLED) driver 111 for driving organic light emitting elements OLED_R and OLED_G. Each of the organic light emitting elements OLED_R and OLED_G emits light of a different color corresponding to an applied current.

The selection signal driver 200 sequentially applies a selection signal or selection signals to the plurality of selection scan lines S1 to Sn so that a data signal or data signals can be programmed to a pixel 110 coupled to a selection scan line of the selection scan lines S1 to Sn corresponding to the pixel 110, and the emission signal driver 300 sequentially applies an emission control signal or emission control signals to the emission scan lines Em1 to Emn in order to control an emission of the organic light emitting elements OLED_R and OLED_G. The data signal driver 400 applies the data signal corresponding to the pixel 110 of the selection scan line to which the selection signal is applied to the data lines D1 to Dm when the selection signal is sequentially applied.

The selection and emission signal drivers 200 and 300 and the data signal driver 400 are respectively coupled to a substrate in which the display panel 100 is formed. Alternatively, the selection and emission signal drivers 200 and 300 and/or the data signal driver 400 may be directly formed on a glass substrate of the display panel 100 so that the selection and emission signal drivers 200 and 300, and/or the data signal driver 400 may be substituted for driving circuits respectively formed on the same layers as those of the selection and emission scan lines S1 to Sn and Em1 and Emm, data lines D1 to Dm, and transistors. Alternatively, the selection emission signal drivers 200 and 300 and/or data signal driver 400 may also be formed in a chip on a flexible printed circuit (FPC), a tape carried package (TCP), or a tape automatic bonding (TAB) in a state of being coupled to the display panel 100.

In operation, a field is divided into two subfields in the first exemplary embodiment of the present invention, and data respectively corresponding to the organic light emitting elements OLED_R and OLED_G are programmed in the two subfields so the emission is generated. The selection signal driver 200 sequentially applies a selection signal to the selection scan lines S1 to Sn for each subfield, and the emission signal driver 300 applies an emission control signal to the emission scan lines Em1 to Emn so that one of the respective color organic light emitting elements OLED_R and OLED_G may be emitted in one subfield. The data signal driver 400 applies a data signal respectively corresponding to the organic light emitting elements OLED_R and OLED_G to the data lines D1 to Dm in the two subfields.

An operation of the organic light emitting diode display according to the first exemplary embodiment of the present invention will be described in more detail with respect to FIG. 3 and FIG. 4.

Figure 3:
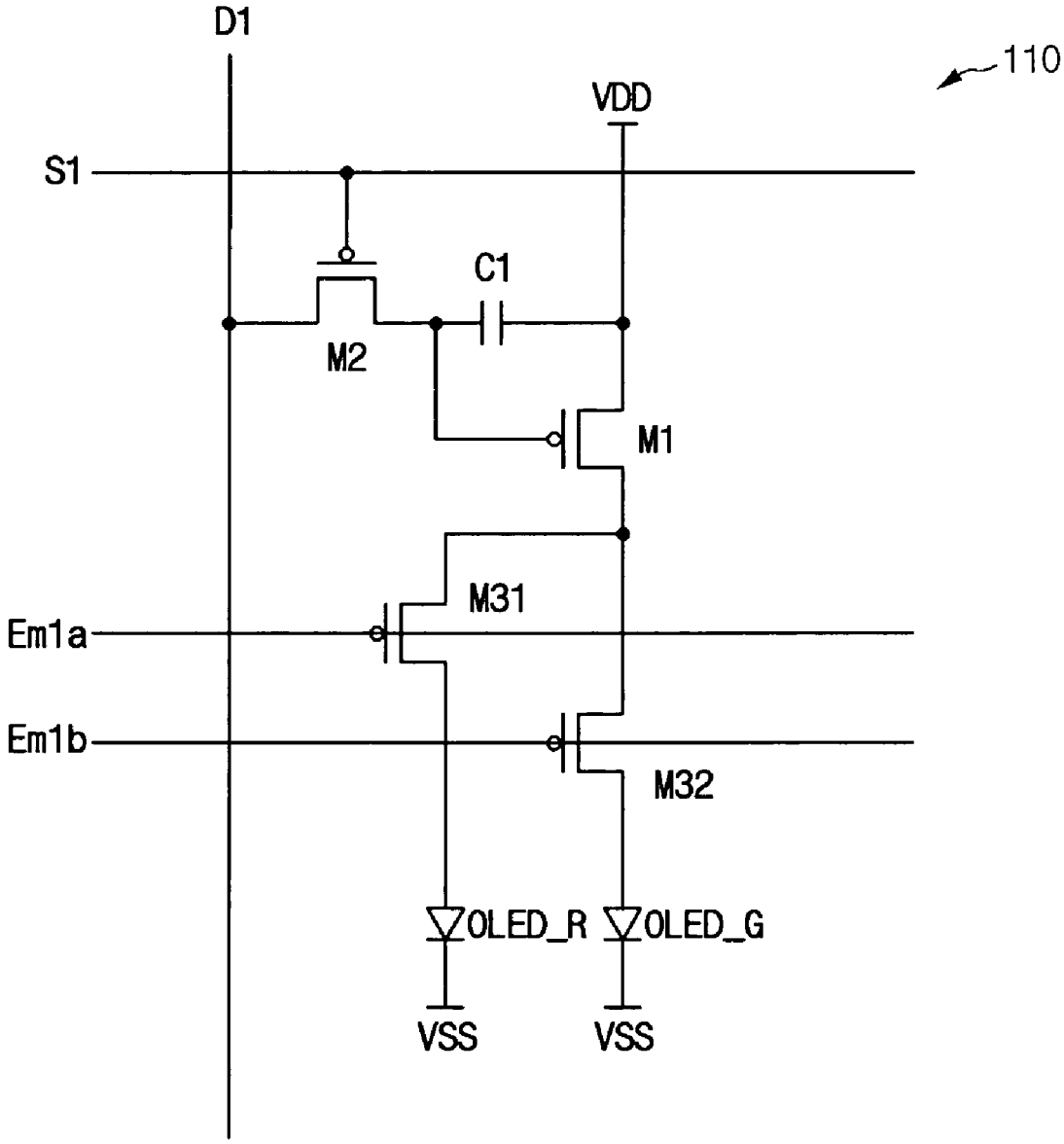
FIG. 3 shows a detailed circuit diagram for representing the pixel of FIG. 2.
Figure 4:
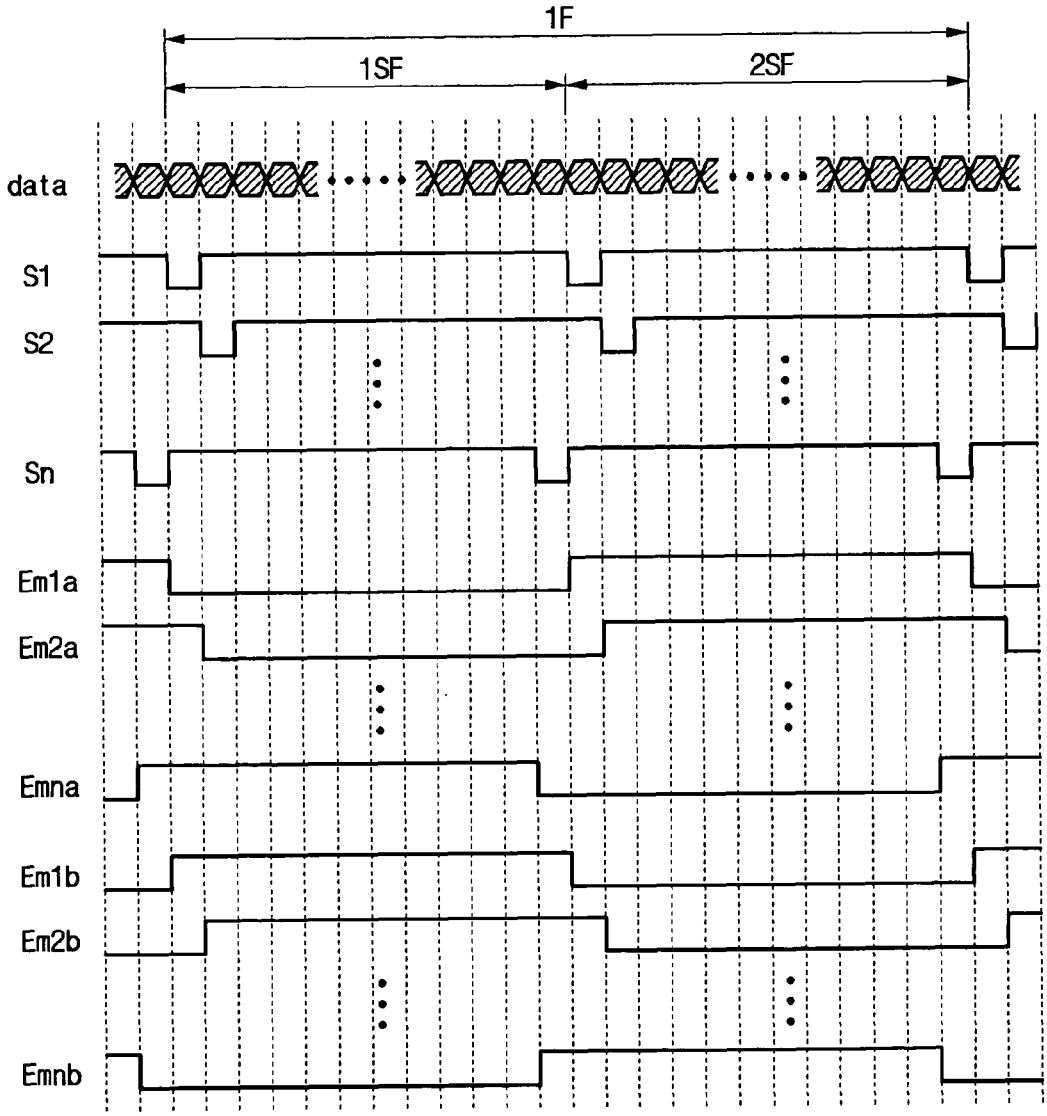
FIG. 4 shows a driving timing chart of the organic light emitting diode display of FIG. 1.

FIG. 3 shows a detailed circuit diagram for representing the pixel 110 of FIG. 2, and FIG. 4 shows a driving timing chart of the organic light emitting diode display of FIG. 1.

In FIG. 3, a voltage programming method pixel 110, which is coupled to the selection scan line S1 and the data line D1, is represented, and the pixel (or pixel circuit) 110 including the organic light emitting element OLED_R for emitting a red light and the organic light emitting element OLED_G for emitting a green light are exemplified.

As shown in FIG. 3, the pixel circuit 110 according to the first exemplary embodiment of the present invention includes a driving transistor M1, a switching transistor M2, the organic light emitting elements OLED_R and OLED_G, and emission control transistors M31 and M32 for respectively controlling the emission of the organic light emitting elements OLED_R and OLED_G. One emission scan line Em1 includes two emission signal lines Em1*a* and Em1*b*. While not illustrated in FIG. 3, each of the other emission scan lines Em2 to Emn also includes two emission signal lines. The emission control transistors M31 and M32 and the emission signal lines Em1*a* and Em1*b* form a switch for selectively transmitting a current of the driving transistor M1 to the organic light emitting elements OLED_R and OLED_G.

The switching transistor M2 has a gate coupled to the selection scan line S1 and a source coupled to the data line D1, and transmits a data voltage from the data line D1 in response to the selection signal from the selection scan line S1. The driving transistor M1 has a source coupled to a power line for supplying a power voltage VDD and a gate coupled to a drain of the switching transistor M2, and a capacitor C1 is coupled between the source and gate of the driving transistor M1. A drain of the driving transistor M1 is coupled to respective sources of the emission control transistors M31 and M32, and gates of the transistors M31 and M32 are respectively coupled to the emission signal lines Em1*a* and Em1*b*. Drains of the emission control transistors M31 and M32 are respectively coupled to anodes of the organic light emitting elements OLED_R and OLED_G, and a power voltage VSS, which is less than the voltage VDD, is applied to cathodes of the organic light emitting elements OLED_R and OLED_G. A negative voltage or a ground voltage can be used for the power voltage VSS.

The switching transistor M2 transmits a data voltage from the data line D1 to the gate of the driving transistor M1 in response to a low level selection signal from the selection scan line S1, and a voltage corresponding to a difference between the data voltage and the power voltage VDD transmitted to the gate of the transistor M1 is stored by the capacitor C1. The emission control transistor M31 is turned on in response to a low level emission control signal from the emission signal line Em1*a*, a current corresponding to the voltage stored by the capacitor C1 from the driving transistor M1 is transmitted to the organic light emitting element OLED_R, and an emission is generated by the organic light emitting element OLED_R.

In a same manner as above, the emission control transistor M32 is turned on in response to a low level emission control signal from the emission signal line Em1*b*, the current corresponding to the voltage stored by the capacitor C1 from the driving transistor M1 is transmitted to the organic light emitting element OLED_G, and an emission is generated by the organic light emitting element OLED_G.

In the first exemplary embodiment, the two emission control signals respectively applied to the two emission signal lines (e.g., the emission signal lines Em1*a* and Em1*b*) respectively have low levels which are not overlapped in a field so that the pixels of the first exemplary embodiment may respectively express different colors with respect to each other.

A method for driving the organic light emitting diode display of FIG. 1 will be described with reference to FIG. 4. As shown in FIG. 4, a field 1F has two subfields 1SF and 2SF, and a signal for operating the organic light emitting elements OLED_R and OLED_G of the respective pixels is applied in the subfields 1SF and 2SF. Periods of the subfields 1SF and 2SF correspond to each other in FIG. 4.

A data voltage R corresponding to the organic light emitting element OLED_R of a first row pixel is applied to the data lines D1 to Dm when a low level selection signal is applied to a first row selection scan line S1 in the subfield 1SF.

A low level emission control signal is applied to a first row emission signal line Em1*a*, the data voltage R is applied to the capacitor (e.g., the capacitor C1) through the switching transistor M2 of each pixel in the first row, and a voltage corresponding to the data voltage R is charged into the capacitor C1. The emission control transistor M31 of the first row pixel is turned on, a current corresponding to a gate-source voltage stored in the capacitor C1 is transmitted to the red organic light emitting element OLED_R from the driving transistor M1, and an emission is generated.

A data voltage R corresponding to a red light of a second row pixel is applied to the data lines D1 to Dm when a low level selection signal is applied to a second row selection scan line S2. The low level emission control signal is applied to the second row emission signal line Em2*a*. The current corresponding to the data voltage R from the data lines D1 to Dm is supplied to the red organic light emitting element OLED_R of the second row pixel, and an emission is generated.

A data voltage R is sequentially applied from a third row pixel to an $(n-1)^{th}$ row pixel, and the red organic light emitting element OLED_R from the third row pixel to the $(n-1)^{th}$ row pixel is emitted. Lastly, a data voltage R corresponding to a red light of an $n^{th}$ row pixel is applied to the data lines D1 to Dm and the low level emission control signal is applied to the $n^{th}$ row emission control signal line Emna when the low level selection signal is applied to the $n^{th}$ row selection signal line Sn. The current corresponding to the data lines D1 to Dm is supplied to the red organic light emitting element OLED_R of the $n^{th}$ row pixel, and an emission is generated.

As described, the data voltage R corresponding to the red light is applied to the respective pixels 110 formed in the display panel 100 in the subfield 1SF. The emission control signal applied to the emission signal lines Em1*a* to Emna is maintained at the low level for a predetermined time, and the organic light emitting element OLED_R coupled to the emission control transistor M31 to which the corresponding emission control signal is applied is continuously emitted while the emission control signal is at the low level. That is, in each pixel 110, the red organic light emitting element OLED_R is emitted with a brightness corresponding to the data voltage R applied for a period corresponding to the subfield 1SF.

In the next subfield 2SF, a low level selection signal is sequentially applied from the first to $n^{th}$ row selection scan lines S1 to Sn in a manner that is substantially the same as the application of the low level selection signal of the subfield 1SF, and a data voltage G corresponding to a green light of the corresponding row pixel is applied to the data lines D1 to Dm when the selection signal is applied to the respective selection scan lines S1 to Sn. The low level emission control signal is sequentially applied to the emission signal lines Em1*b* to Emnb as the low level selection signal is sequentially applied to the selection scan lines S1 to Sn. A current corresponding to the applied data voltage is then transmitted to the red organic light emitting element OLED_G through the emission control transistor M32, and an emission is generated.

In the subfield 2SF, the emission control signal applied to the emission signal lines Em1*b* to Emnb is also maintained at the low level for a predetermined period, and the green organic light emitting element OLED_G coupled to the emission control transistor M32 to which the corresponding emission control signal is applied is continuously emitted while the emission control signal is at the low level. In FIG. 4, the predetermined period corresponds to the subfield 2SF. That is, the green organic light emitting element OLED_G is emitted with a brightness corresponding to the data voltage G applied for a period corresponding to the subfield 2SF in the respective pixels.

As described and/or shown, in accordance with a method for driving an organic light emitting diode display according to the first exemplary embodiment of the present invention, one field is divided into two subfields which are sequentially driven. An organic light emitting element of one color is emitted in one pixel for each subfield, and organic light emitting elements of two colors are sequentially emitted through the two subfields.

According to the first exemplary embodiment of the present invention, light emitting elements emitting various colors are operated in one pixel by using common driving and switching transistors and a capacitor, and therefore a configuration of elements used in a pixel and lines (e.g., scan and data lines) for transmitting a current, a voltage, and/or a signal are simplified.

While it has been described in FIG. 4 that an organic light emitting diode display can be operated using a single scan method and/or a progressive scan method, the present invention would not be limited to the above, and the present invention can include various other scan methods such as a dual scan method or an interlaced scan method.

While a pixel circuit of a voltage programming method using a switching transistor and a driving transistor has been described in the first exemplary embodiment of the present invention, the present invention can include a voltage programming method using a transistor for compensating a threshold voltage of the driving transistor or a transistor for compensating a voltage reduction.

Figure 5:
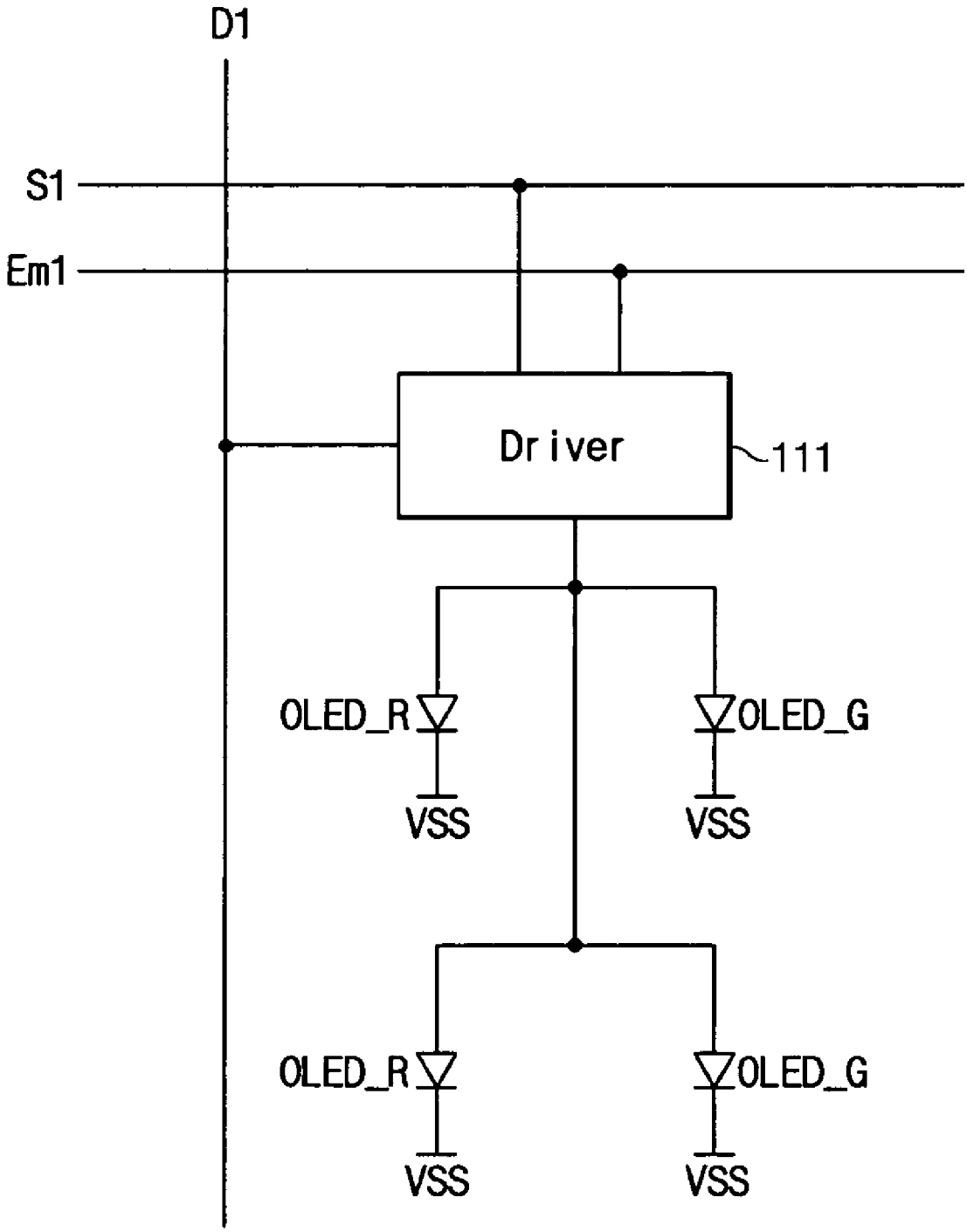
FIG. 5 shows a schematic diagram for representing a pixel of an organic light emitting diode display according to a second exemplary embodiment of the present invention.

FIG. 5 schematically shows a pixel of an organic light emitting diode display according to a second exemplary embodiment of the present invention.

A pixel of the organic light emitting diode display according to the second exemplary embodiment of the present invention substantially corresponds to the pixel circuit according to the first exemplary embodiment of the present invention except that one pixel operates four organic light emitting elements formed in two rows.

In detail, an OLED driver 111 operates (or drives) two organic light emitting elements OLED_R and OLED_G formed in a first row and two organic light emitting elements OLED_R and OLED_G formed in a second row. At this time, a field is divided into four subfields to be used, and each of the organic light emitting elements OLED_R and OLED_G of the first and second rows is sequentially emitted in the respective subfields.

In the second exemplary embodiment of the present invention, four organic light emitting elements OLED_R and OLED_G vertically and horizontally neighboring with each other are operated by one OLED driver 111, and therefore organic light emitting elements in two rows are operated by one selection scan line S1, and organic light emitting elements in two columns are operated by one data line D1. Accordingly, the number of selection scan lines and data lines formed in a display panel is reduced to half as compared with a display panel having an OLED driver that drives only two organic light emitting elements, and aperture ratio is increased.

In addition, the internal configuration of the selection signal and data signal drivers (e.g., the selection signal and data signal drivers 200 and 400) for driving the scan lines S1 to Sn and the data lines D1 to Dm is simplified, the area that each driver occupies is reduced when the driver is formed on the display panel, and therefore a dead space (non-emission area) is reduced.

Figure 6:
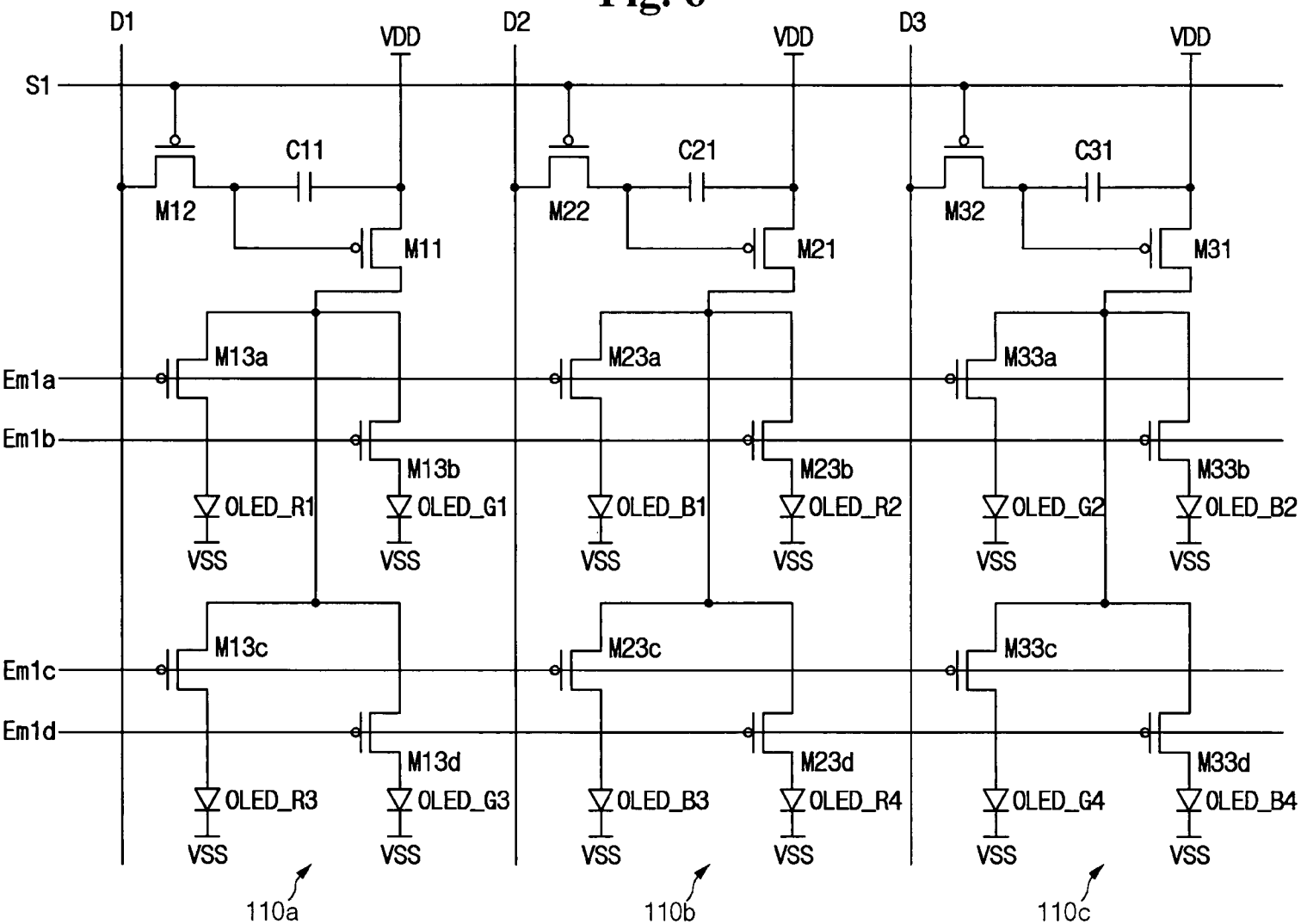
FIG. 6 shows a detailed circuit diagram for representing the pixel of FIG. 5.

FIG. 6 shows a detailed circuit diagram for representing the pixel of FIG. 5. In FIG. 6, three pixels 110*a* to 110*c* formed in a pixel area defined by three data lines D1 to D3 and the selection signal S1 are illustrated for exemplary purposes, and the invention is not thereby limited.

Hereinafter, a configuration and operation of the pixel circuit according to the second exemplary embodiment of the present invention will be described with reference to FIG. 6. It will be described focusing on a pixel 110*a* formed in a pixel area defined by the data line D1 and the selection scan line S1 among the three pixels 110*a* to 110*c*, and parts that are substantially the same as the parts described in the first exemplary embodiment of the present invention will not be described again.

According to the second exemplary embodiment of the present invention, the OLED driver 111 includes a driving transistor M11, a switching transistor M12, a capacitor C11, and four emission control transistors M13*a*, M13*b*, M13*c*, and M13*d*.

The emission control transistors M13*a* and M13*b* transmit a current to two organic light emitting elements OLED_R1 and OLED_G1 formed in the first column, gates of the emission control transistors M13*a* and M13*b* are respectively coupled to the emission signal lines Em1*a* and Em1*b*, sources of the emission control transistors M13*a* and M13*b* are coupled to a drain of the driving transistor M11, and drains of the emission control transistors M13*a* and M13*b* are coupled to anodes of the organic light emitting elements OLED_R1 and OLED_G1.

The emission control transistors M13*c* and M13*d* transmit a current to two organic light emitting elements OLED_R3 and OLED_G3 formed in the second column, gates of the emission control transistors M13*c* and M13*d* are respectively coupled to the emission signal lines Em1*c* and Em1*d*, sources of the emission control transistors M13*c* and M13*d* are coupled to the drain of the driving transistor M11, and drains of the emission control transistors M13*c* and M13*d* are coupled to anodes of the organic light emitting elements OLED_R3 and OLED_G3.

When the pixel is formed as above and a low level emission control signal is sequentially applied to the emission signal lines Em1*a* to Em1*d* in the four subfields, the current of the driving transistor M11 is transmitted to the organic light emitting elements OLED_R1, OLED_G1, OLED_R3, and OLED_G3 through the emission control transistors M13*a* to M13*d*, and an emission is generated.

Further, in the second exemplary embodiment of the present invention, organic light emitting elements emitting red, green, and blue lights are repeatedly formed in a horizontal direction, one OLED driver 111 operates organic light emitting elements horizontally neighboring each other, and therefore one OLED driver 111 operates organic light emitting elements (e.g., organic light emitting element OLED_R1 and OLED_G1), which emit different colors with respect to each other.

Figure 7:
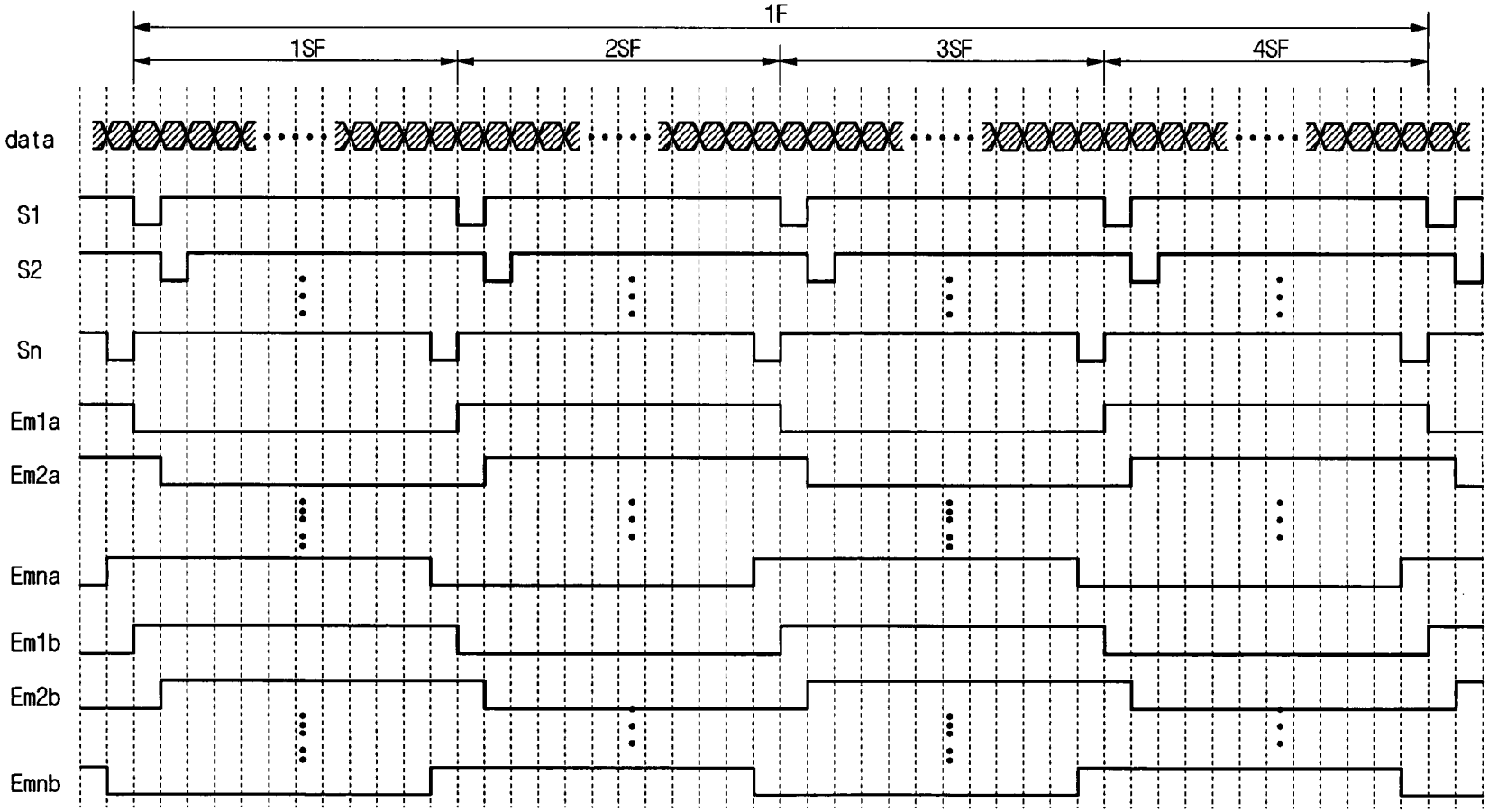
FIG. 7 shows a driving timing chart of the organic light emitting diode display of FIG. 5.

In more detail and referring also to FIG. 7, when one subfield 1F is divided into first to fourth subfields 1SF, 2SF, 3SF, and 4SF to be used, in the first subfield 1SF, a data voltage corresponding to the organic light emitting element OLED_R1 for emitting a red light is applied to the data line D1, a low level emission control signal is applied to the emission signal line Em1*a*, and a current of the driving transistor M11 flows to the organic light emitting element OLED_R1. In the second subfield 2SF, a data voltage corresponding to the organic light emitting element OLED_G1 for emitting a green light is applied to the data line D1, a low level emission control signal is applied to the emission signal line Em1*b*, and a current of the transistor M11 flows to the organic light emitting element OLED_G1. In the third subfield 3SF, a data voltage corresponding to the organic light emitting element OLED_R3 for emitting a red light is applied to the data line D1, a low level emission control signal is applied to the emission signal line Em1*c*, and a current of the driving transistor M11 flows to the organic light emitting element OLED_R3. In the fourth subfield 4SF, a data voltage corresponding to the organic light emitting element OLED_G3 for emitting a green light is applied to the data line D1, the low level emission control signal is applied to the emission signal line Em1*d*, and a current of the driving transistor M11 flows to the organic light emitting element OLED_G3.

As described and/or shown, four organic light emitting elements are operated by one driver in the second exemplary embodiment because one field is divided into four subfields and four organic light emitting elements are sequentially operated in the respective subfields.

However, in the second exemplary embodiment of the present invention, it is difficult to control the white balance of red, green, and blue images by controlling characteristics of the driving transistor when one driver operates organic light emitting elements which emit different colors with respect to each other.

Therefore, in a third exemplary embodiment of the present invention in order to enhance the second exemplary embodiment of the present invention, a driver is allowed to operate organic light emitting elements that emit the same colors.

A pixel of an organic light emitting diode display according to a third exemplary embodiment of the present invention will be described with reference to FIG. 8.

Figure 8:
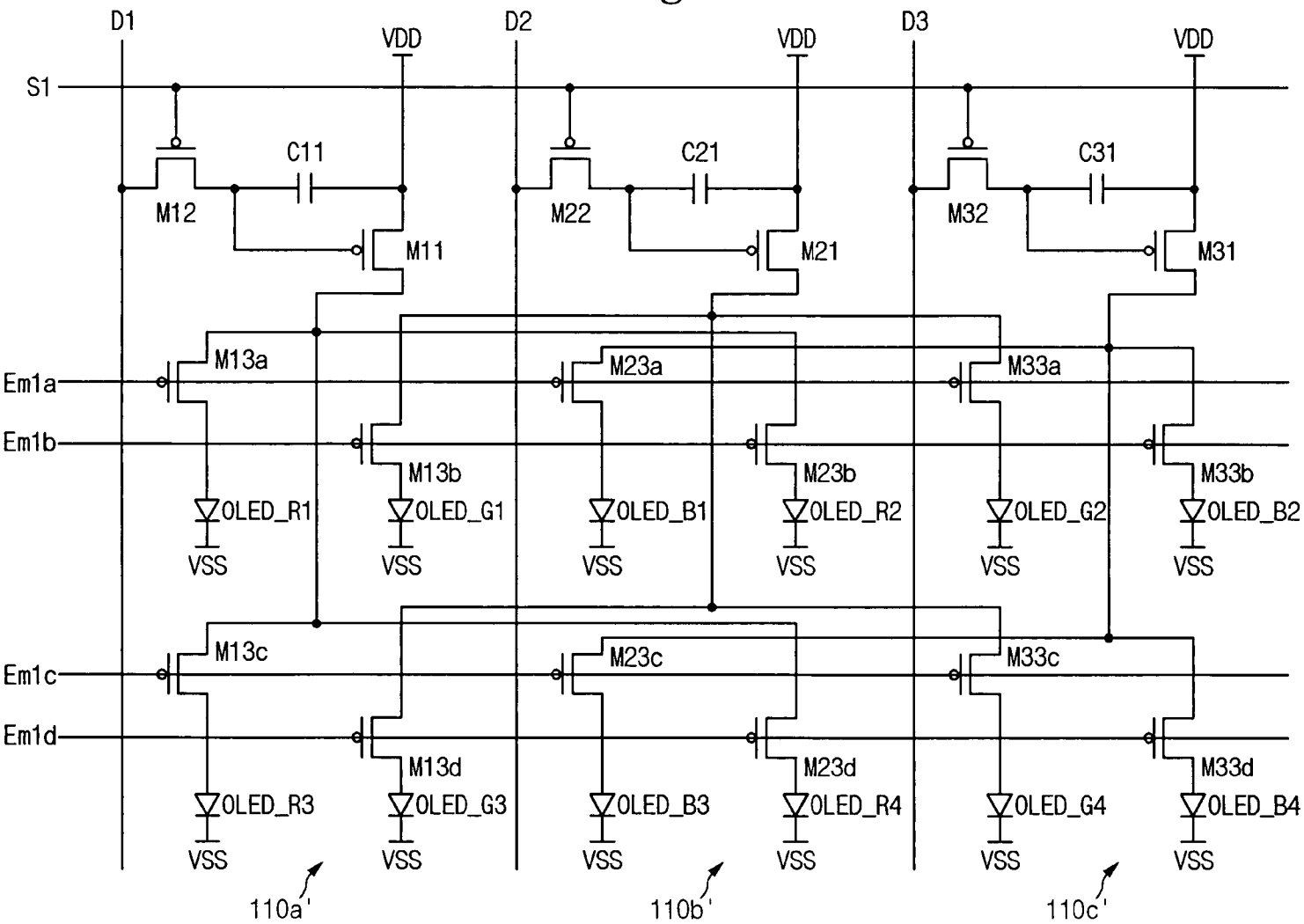
FIG. 8 shows a detailed circuit diagram for representing a pixel of an organic light emitting diode display according to a third exemplary embodiment of the present invention.

FIG. 8 shows a circuit diagram for representing the pixel of the organic light emitting diode display according to the third exemplary embodiment of the present invention.

According to the third exemplary embodiment of the present invention, respective pixels 110*a*' to 110*c*' include an OLED driver and four organic light emitting elements, and data signals corresponding to red, green, and blue are applied to data lines D1 to D3.

The OLED driver of the pixel 110*a*' is coupled to the data line D1, and applies a current corresponding to a red light to organic light emitting elements OLED_R1, OLED_R2, OLED_R3, and OLED_R4 through emission control transistors M13*a*, M23*b*, M13*c*, and M23*d*. A drain of driving transistor M11 is coupled to the emission control transistors M13*a*, M23*b*, M13*c*, and M23*d*, and a current of the driving transistor M11 is transmitted to the organic light emitting elements OLED_R1, OLED_R2, OLED_R3, and OLED_R4 in response to an emission control signal applied to a gate of each of the emission control transistors M13*a*, M23*b*, M13*c*, and M23*d*.

The OLED driver of the pixel 110*b*' is coupled to the data line D2, and applies a current corresponding to a green light to organic light emitting elements OLED_G1, OLED_G2, OLED_G3, and OLED_G4 through emission control transistors M13*b*, M33*a*, M13*d*, and M33*c*. That is, a drain of driving transistor M21 is coupled to the emission control transistors M13*b*, M33*a*, M13*d*, and M33*c*, and a current of the driving transistor M21 is transmitted to the organic light emitting elements OLED_G1, OLED_G2, OLED_G3, and OLED_G4 in response to an emission control signal applied to a gate of each of the emission control transistors M13*b*, M33*a*, M13*d*, and M33*c*.

In a like manner, the OLED driver of the pixel 110*c*' is coupled to the data line D3, and applies a current corresponding to a blue light to organic light emitting elements OLED_B1, OLED_B2, OLED_B3, and OLED_B4 through emission control transistors M23*a*, M33*b*, M23*c*, and M33*d*. That is, a drain of driving transistor M31 is coupled to the emission control transistors M23*a*, M33*b*, M23*c*, and M33*d*, and a current of the driving transistor M31 is transmitted to the organic light emitting elements OLED_B1, OLED_B2, OLED_B3, and OLED_B4 in response to an emission control signal applied to a gate of each of the emission control transistors M23*a*, M33*b*, M23*c*, and M33*d*.

As a result, the data voltage corresponding to one color is applied to one data line in one field, and one driving transistor transmits a current corresponding to the data voltage to the organic light emitting elements emitting the same colors.

In the third exemplary embodiment, a white balance of a display panel is controlled because a current flowing to same color organic light emitting elements is controlled when a driving transistor in one pixel has a controlled channel-width-and-length ratio of the driving transistor in one field. That is, the channel-width-and-length ratios of the transistors M11 to M31 are established to be different from each other in FIG. 8, to thereby control the different amounts of currents respectively flowing to the red, green, and blue organic light emitting elements derived by different data voltages to have substantially corresponding levels with respect to each other.

The current flowing to the organic light emitting element is, however, affected by a threshold voltage of the driving transistor when the pixel circuit is formed as in the third exemplary embodiment of the present invention. Therefore it will be difficult to get high gray scales when variation of the threshold voltages between film transistors exist due to irregularity in a producing process.

A compensation circuit for compensating the threshold voltage is provided in a fourth exemplary embodiment of the present invention, and therefore the current flowing to the organic light emitting element is not affected by the threshold voltage of the driving transistor.

Figure 9:
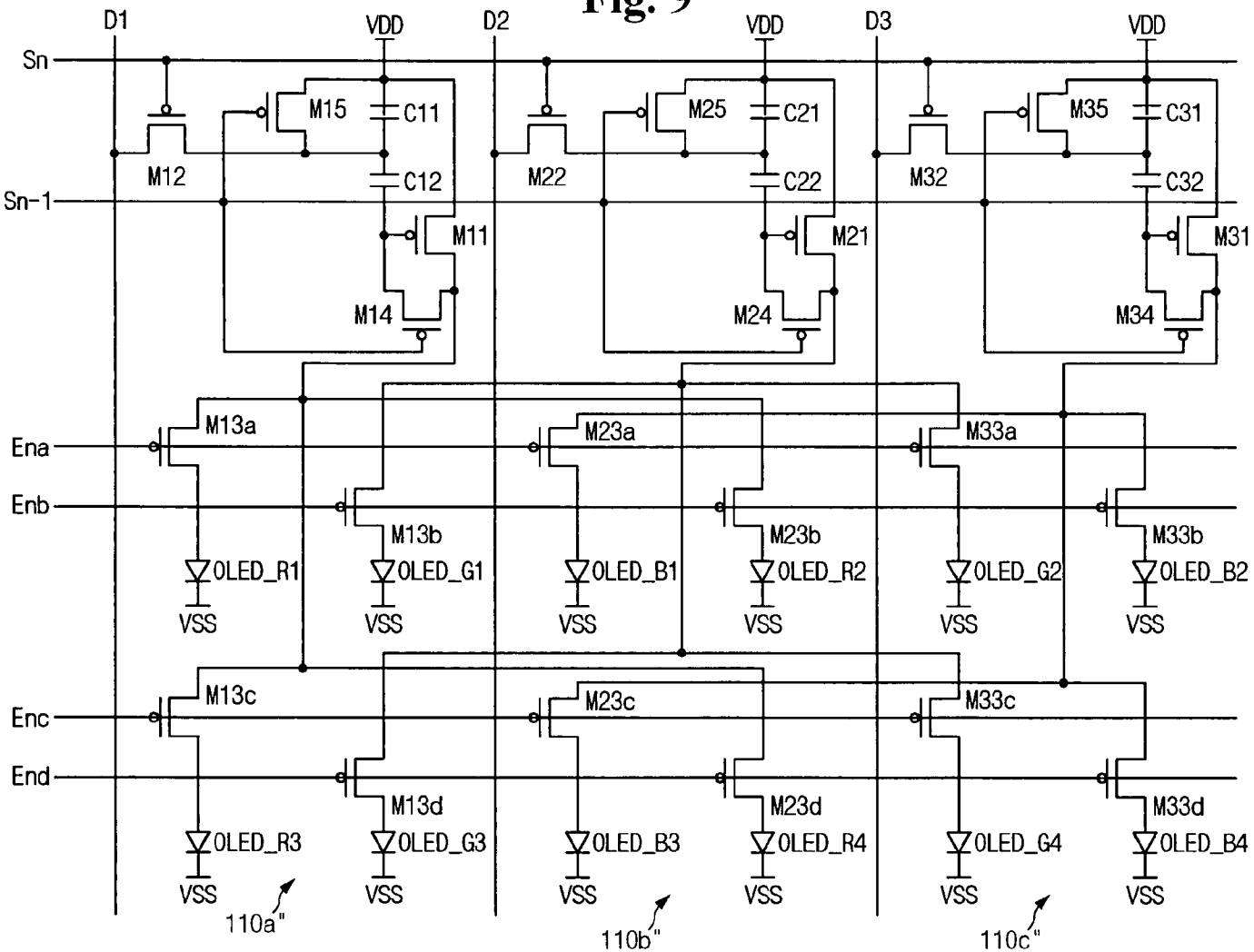
FIG. 9 shows a detailed circuit diagram for representing a pixel of an organic light emitting diode display according to a fourth exemplary embodiment of the present invention.

FIG. 9 shows a circuit diagram for representing a pixel of an organic light emitting diode display according to a fourth exemplary embodiment of the present invention.

The pixel circuit according to the fourth exemplary embodiment of the present invention is substantially the same as the third exemplary embodiment of the present invention except that an OLED driver further includes two additional transistors for compensating variation of a threshold voltage of a driving transistor and an additional capacitor.

Hereinafter, the pixel circuit according to the fourth exemplary embodiment of the present invention is shown to include pixels 110*a*", 110*b*", 110*c*" but will be described focusing on the pixel 110*a*", and parts that are substantially the same as the parts described in the third exemplary embodiment of the present invention will be omitted. A selection scan line for transmitting a present selection signal will be referred to as "a present scan line," and a selection scan line for transmitting a selection signal before the present selection signal is transmitted will be referred to as "a previous scan line."

In FIG. 9, a capacitor C12 is coupled between a gate of a transistor M11 and a capacitor C11. A transistor M14 is coupled between the gate and a drain of the transistor M11, and diode connects the transistor M11 in response to a selection signal from a previous scan line Sn-1. A transistor M15 is coupled between a power line for supplying a power voltage VDD and an electrode of the capacitor C12 and the capacitor C11, and applies a power voltage VDD to the electrode of the capacitor C12 in response to the selection signal from the previous scan line Sn-1.

In operation, when a low level voltage is applied to the previous scan line Sn-1, the transistor M14 is turned on, the transistor M11 is diode-connected, the transistor M15 is turned on, and the threshold voltage of the transistor M11 is stored by the capacitor C12.

When the low level voltage is applied to the present scan line Sn, the transistor M12 is turned on and a data voltage Vdata is charged into the capacitor C1. The threshold voltage Vth of the transistor M11 is stored by the capacitor C12, and therefore a voltage corresponding to a sum of the threshold voltage Vth of the transistor M11 and the data voltage Vdata is applied to the gate of the transistor M11.

A current as given in Equation 1 is transmitted to the organic light emitting element and an emission is generated when the low level voltage is applied to one of emission scan lines Emna to Emnd, and emission control transistors M13*a*, M23*b*, M13*c*, and M23*d* are turned on.

$$I_{OLED} = \frac{\beta}{2}(Vgs - Vth)^2 = \frac{\beta}{2}((Vdata + Vth - VDD) - Vth)^2 = \frac{\beta}{2}(VDD - Vdata)^2 \quad \text{[Equation 1]}$$

where $I_{OLED}$ denotes a current flowing to the organic light emitting element, Vgs denotes a voltage between the source and gate of the transistor M11, Vth denotes a threshold voltage of the transistor M11, Vdata denotes a data voltage, and β is a constant.

Accordingly, the current flowing to the organic light emitting elements OLED_R1, OLED_R2, OLED_R3, and OLED_R4 is not affected by the threshold voltage of the transistor M11, and an image with desired gray scales is represented.

When the selection signal is applied to the previous scan line Sn-1 and a voltage corresponding to the threshold voltage of the transistor M11 is stored by the capacitor C12 in the pixel 110*a*", the voltage stored to the capacitor C12 is affected by a voltage of the drain electrode of the driving transistor M11. At this time, the voltage of the drain electrode is affected by the current flowing through the transistor M11 in a previous subfield.

In the fourth exemplary embodiment of the present invention, the driving transistor M11 outputs a current corresponding to a red light in the previous subfield and the present subfield, and therefore a voltage for compensating a variation of the threshold voltage of the transistor M11 is stored by the capacitor C12 under the same condition as the present subfield. Therefore, the variation of the threshold voltage at the driving transistor M11 is effectively compensated because the voltage corresponding to the threshold voltage is charged in the previous and present subfields under the same condition even though a parasitic capacitance exists at the drain electrode of the driving transistor M11 and a different voltage from the threshold voltage of the driving transistor M11 is charged.

While the present invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

While it has been illustrated that one driving transistor is coupled to four organic light emitting elements through emission control transistors in FIG. 5 to FIG. 9, one driving transistor may be established to operate other numbers of organic light emitting elements. That is, one driving transistor may operate red, green, and blue organic light emitting elements respectively formed in two columns when the pixel is formed as in FIG. 5 and FIG. 6, and one driving transistor may operate three organic light emitting elements which emit the same colors as each other and are respectively formed in two columns when the pixel is formed as in FIG. 8 and FIG. 9. One driving transistor may also be established to operate organic light emitting elements formed in more than three rows according to certain exemplary embodiments.

While it has been described that the driving transistor is a P-channel transistor, an N-channel transistor may be used according to certain exemplary embodiments. In addition, besides a MOS transistor, the driving transistor may be realized using another active element for controlling a current transmitted to a third electrode corresponding to a voltage applied between a first electrode and a second electrode.

As described, the present invention provides a light emitting diode display in which an aperture ratio is increased by using one driver to operate a plurality of organic light emitting elements.

The present invention also provides a light emitting diode display for simplifying an arrangement of lines (e.g., scan and data lines) and a configuration of elements in a pixel.

Further, internal configurations of a data signal driver and a scan driver (e.g., a selection signal driver and/or an emission signal driver) may be simplified by reducing the number of data lines and scan lines formed in a display panel, and the dead space (non-emission area) may be reduced by reducing an area needed for the drivers in the display panel.

What is claimed is:

1. An organic light emitting diode display comprising a plurality of data lines for transmitting data signals, a plurality of scan lines for transmitting selection signals, a plurality of pixels coupled to the data lines and the scan lines, and a plurality of pixel areas each defined by two neighboring data lines of the data lines and two neighboring scan lines of the scan lines, wherein each of the pixels comprises:

at least four light emitting elements for emitting light in response to an applied current;

a light emitting element driver for receiving at least one of the data signals through one of the plurality of data lines while a corresponding one of the selection signals is applied, and for outputting a data current through a transistor corresponding to the at least one of the data signals; and a switching unit for respectively transmitting the data current from the transistor of the light emitting element driver to the at least four light emitting elements, wherein for at least one of the pixels, at least two light emitting elements of the at least four light emitting elements are formed in adjacent pixel areas separated by a corresponding data line from among the plurality of pixel areas while configured to be controlled by data signals transmitted through the one of the plurality of data lines, and wherein at least one light emitting element of at least one other pixel from among the plurality of pixels is positioned substantially between the at least two light emitting elements, wherein for at least another one of the pixels, the light emitting element driver is formed in a pixel area while its corresponding at least four light emitting elements are formed in pixel areas different than the pixel area in which the light emitting element driver is formed, such that the light emitting element driver does not output current to any light emitting elements formed in the same pixel area in which the light emitting element driver is formed, and wherein the light emitting element driver of each of the pixels is configured to output data current corresponding to the data signals received through the one of the plurality of data lines through the transistor to at least two light emitting elements along a same row, such that a number of light emitting elements along a row direction of the organic light emitting diode display is greater than a total number of data lines in the organic light emitting diode display.

2. The organic light emitting diode display of claim 1, wherein the at least four light emitting elements are respectively formed in two columns, and at least two light emitting elements of the at least four light emitting elements are assigned to each of the two columns.

3. The organic light emitting diode display of claim 1, wherein the transistor comprises first, second, and third electrodes for outputting the data current corresponding to a voltage applied between the first and second electrodes to the third electrode, and wherein the light emitting element driver further comprises:

a first capacitor for storing a voltage corresponding to the at least one of the data signals; and a first switch for transmitting the at least one of the data signals to the first capacitor in response to the corresponding one of the selection signals.

4. The organic light emitting diode display of claim 3, wherein the second electrode of the transistor is coupled to a first power line, and the light emitting element driver further comprises:

a second capacitor coupled between the first electrode of the transistor and the first capacitor;

a second switch for diode connecting the transistor in response to a first control signal; and a third switch for applying a voltage of the first power line to an electrode of the second capacitor in response to a second control signal.

5. The organic light emitting diode display of claim 4, wherein the first control signal is substantially the same as the second control signal.

6. The organic light emitting diode display of claim 4, wherein the first control signal is another one of the selection signals of a previous one of the scan lines applied before the corresponding one of the selection signals of a current one of the scan lines is applied.

7. The organic light emitting diode display of claim 1, wherein the switching unit comprises at least fourth, fifth, sixth, and seventh switches for respectively transmitting the data current to the at least four light emitting elements in different periods.

8. The organic light emitting diode display of claim 1, wherein at least two of the four light emitting elements emit lights having different colors.

9. The organic light emitting diode display of claim 1, wherein the at least four light emitting elements emit light having substantially the same color.

10. The organic light emitting diode display of claim 1, wherein the at least one light emitting element of the at least one other pixel is positioned in one of the adjacent pixel areas.

11. A display panel for an organic light emitting display comprising:

a display unit comprising a plurality of data lines for transmitting data signals, a plurality of scan lines for transmitting selection signals, a plurality of pixels coupled to the data lines and the scan lines, and a plurality of pixel areas each defined by two neighboring data lines of the data lines and two neighboring scan lines of the scan lines;

a data signal driver for time-dividing at least four of the data signals and for applying the time-divided data signals to at least one of the plurality of data lines in one field; and a scan driver for sequentially applying the selection signals to the plurality of scan lines, wherein each of the pixels comprises:

at least four light emitting elements for emitting light in response to an applied current, a light emitting element driver for receiving the time-divided data signals through one of the plurality of data lines while a corresponding one of the selection signals is applied and for outputting a data current through a transistor corresponding to at least one of the time-divided data signals, and a switching unit for respectively transmitting the data current from the transistor of the light emitting element driver to the at least four light emitting elements, wherein first and second light emitting elements of the at least four light emitting elements are formed parallel to at least one of the scan lines, and third and fourth light emitting elements of the at least four light emitting elements are vertically formed with respect to the first and second light emitting elements, wherein for at least one of the pixels, at least two light emitting elements of the at least four light emitting elements are formed in adjacent pixel areas separated by a corresponding data line from among the plurality of pixel areas while configured to be controlled by corresponding ones of the time-divided data signals transmitted through the one of the plurality of data lines, wherein at least one light emitting element of at least one other pixel from among the plurality of pixels is positioned substantially between the at least two light emitting elements, wherein for at least another one of the pixels, the light emitting element driver is formed in a pixel area while its corresponding at least four light emitting elements are formed in pixel areas different than the pixel area in which the light emitting element driver is formed, such that the light emitting element driver does not output current to any light emitting elements formed in the same pixel area in which the light emitting element driver is formed, and wherein the light emitting element driver of each of the pixels is configured to output data current corresponding to the data signals received through the one of the plurality of data lines through the transistor to at least two light emitting elements along a same row, such that a number of light emitting elements along a row direction of the display panel is greater than a total number of data lines in the display panel.

12. The display panel of claim 11, wherein the one field is divided into at least four subfields to be driven, and the scan driver sequentially applies the selection signals to the plurality of scan lines for the respective subfields.

13. The display panel of claim 12, wherein the data signal driver sequentially applies the time-divided data signals corresponding to the first, second, third, and fourth light emitting elements of the at least four light emitting elements to a corresponding one of the data lines while a corresponding one of the selection signals is applied to a corresponding one of the scan lines in the at least four subfields.

14. The display panel of claim 13, wherein the corresponding one of the selection signals comprises at least four non-overlapping signal levels.

15. The display panel of claim 14, wherein each of the at least four non-overlapping levels is a low signal level.

16. The display panel of claim 12, wherein the scan driver comprises a selection signal driver.

17. The display panel of claim 11, wherein the transistor comprises first, second, and third electrodes for outputting a current corresponding to a voltage applied between the first and second electrodes to the third electrode, and wherein the light emitting element driver further comprises:

a capacitor for storing a voltage corresponding to the at least one of the time-divided data signals; and a first switch for transmitting the at least one of the time-divided data signals to the capacitor in response to a corresponding one of the selection signals.

18. The display of claim 11, wherein the switching unit comprises at least second, third, fourth, and fifth switches for respectively transmitting the data current to the at least four light emitting elements in different periods.

19. The display of claim 18, wherein the scan driver comprises a selection signal driver for sequentially applying the selection signals to the plurality of scan lines and an emission signal driver for controlling the at least second, third, fourth, and fifth switches.

20. A method for driving a display panel comprising a plurality of data lines for transmitting data signals, a plurality of scan lines for transmitting selection signals, a plurality of pixels coupled to the data lines and the scan lines, and a plurality of pixel areas each defined by two neighboring data lines of the data lines and two neighboring scan lines of the scan lines, wherein a field is divided into at least four subfields to be driven, the method comprising:

sequentially applying the selection signals to the plurality of scan lines in the respective subfields of the at least four subfields;

programming at least one of the data signals to one of the plurality of data lines while a corresponding one of the selection signals is applied; and sequentially transmitting a current corresponding to the at least one of the data signals from a transistor of a light emitting element driver corresponding to one of the plurality of pixels to at least four light emitting elements corresponding to the one of the plurality of pixels, wherein first and second light emitting elements of the at least four light emitting elements are formed parallel to at least one of the scan lines, and third to fourth light emitting elements, of the at least four light emitting elements are formed in a vertical direction with respect to the first and second light emitting elements, wherein for at least one of the pixels, at least two light emitting elements of the at least four light emitting elements are formed in adjacent pixel areas separated by a corresponding data line from among the plurality of pixel areas while being controlled by the data signals transmitted through the one of the plurality of data lines, wherein at least one light emitting element corresponding to at least one other pixel from among the plurality of pixels is positioned substantially between the at least two light emitting elements, wherein for at least another one of the pixels, the light emitting element driver is formed in a pixel area while its corresponding at least four light emitting elements are formed in pixel areas different than the pixel area in which the light emitting element driver is formed, such that the light emitting element driver does not output current to any light emitting elements formed in the same pixel area in which the light emitting element driver is formed, and wherein the transistor of the light emitting element driver sequentially transmits the current corresponding to the at least one of the data signals from the one of the plurality of data lines to at least two light emitting elements along a same row, such that a number of light emitting elements along a row direction of the display panel is greater than a total number of data lines in the display panel.

21. The method of claim 20, wherein a subset of the data signals corresponding to the first, second, third, and fourth light emitting elements of the at least four light emitting elements is sequentially programmed to the at least one of the plurality of data lines.

* * * * *